US005325996A

United States Patent [19]

Bannigan

[11] Patent Number: 5,325,996

[45] Date of Patent: Jul. 5, 1994

[54] BEVERAGE VESSEL WITH FLAVORING CONCENTRATE DISPENSER

[75] Inventor: Francis R. Bannigan, Huntingdale, Australia

[73] Assignee: Gondal Pty. Ltd., Victoria, Australia

[21] Appl. No.: 43,898

[22] Filed: Apr. 7, 1993

[51] Int. Cl.[5] ..... B67D 5/56

[52] U.S. Cl. ..... 222/133; 222/129; 222/205; 222/385

[58] Field of Search ..... 222/129, 130, 133, 145, 222/205, 321, 372, 383, 385, 465.1

[56] References Cited

U.S. PATENT DOCUMENTS

| | | | |
|---|---|---|---|
| Re. 2,711 | 8/1867 | Bigelow | 222/133 |
| 592,490 | 10/1897 | Fangel | 222/145 |
| 594,087 | 11/1897 | Jenkins | 222/145 |
| 1,548,120 | 8/1925 | Doursoh | 222/383 X |
| 1,946,473 | 2/1934 | Babendreer et al. | 222/133 |
| 2,137,527 | 11/1938 | Cunningham | 222/133 |
| 2,216,890 | 10/1940 | Philipps | 222/133 |
| 2,438,906 | 4/1948 | Elsas et al. | 222/129 X |
| 2,774,517 | 12/1956 | Teegardin et al. | 222/205 |
| 3,333,738 | 8/1967 | Goss | 222/129 |
| 3,347,420 | 10/1967 | Donoghue | 222/129 |
| 3,727,800 | 4/1973 | Santos | 222/129 |
| 3,851,800 | 12/1974 | Swain | 222/145 |
| 4,585,150 | 4/1986 | Beacham et al. | 222/129 |
| 4,678,103 | 7/1987 | Dirksing | 222/130 |
| 4,819,833 | 4/1989 | Huddleston et al. | 222/130 X |
| 4,958,749 | 9/1990 | Kuenzel et al. | 222/133 |
| 4,993,595 | 2/1991 | Bertram et al. | 222/129 |
| 5,054,656 | 10/1991 | Lasner | 222/385 X |

FOREIGN PATENT DOCUMENTS

| | | | |
|---|---|---|---|
| 61097 | 12/1947 | Netherlands | 222/133 |

*Primary Examiner*—Kevin P. Shaver
*Attorney, Agent, or Firm*—Larson and Taylor

[57] ABSTRACT

A dispenser (50) for flavoring concentrate is adapted to be attached to an open mouthed beverage vessel (10). The dispenser (60) comprises a reservoir (51), a manually operable pump (52) and a storage chamber (60). The reservoir is arranged to contain concentrate, and the pump is coupled to the reservoir to dispense a measured quantity of concentrate to the storage chamber. The dispenser is adapted to be secured across the mouth of the vessel so that tilting of the vessel ensures escape of the concentrate from the storage chamber prior to escape of the beverage within the vessel.

6 Claims, 5 Drawing Sheets

BEVERAGE VESSEL WITH FLAVORING CONCENTRATE DISPENSER

FIELD OF THE INVENTION

This invention relates to a flavouring concentrate dispenser and to a vessel or jug incorporating the dispenser.

Jugs and vessels for beverages come in a variety of shapes and forms, some vessels for beverages incorporate filters that allow tap water to be filtered prior to consumption. The jugs or vessels are often designed so that they can stored in a domestic refrigerator. A popular beverage is a combination of water and a flavouring concentrate usually in liquid form and known as cordial. It is usual to store the cordial in a separate vessel, dispense a predetermined portion of cordial into a drinking receptacle and then add water. In some cases, the cordial and water are pre-mixed and then stored in a suitable jug. It is foreseen that there is a need for a beverage vessel or jug that can store water either filtered or unfiltered together with a source of flavouring concentrate so on selection, the jug can either dispense a mixture of the water and flavouring concentrate or the water without the flavouring concentrate.

The applicant company manufactures a range of water filters that comprise a tall plastics vessel divided into two vertically spaced compartments joined by a narrow passageway that supports a filter cartridge. Tap water is fed into the vessel from the top to be filtered as it passes through the filter cartridge to be collected in the lower compartment. A spout is in fluid communication with the lower compartment to facilitate pouring of the filtered water from the vessel.

The present invention relates to a dispenser for flavouring concentrate that can be used with water filters of the kind described above. The invention also extends to beverage vessels that incorporate a flavouring concentrate dispenser.

FIELD OF THE INVENTION

According to one aspect of the invention there is provided a dispenser for flavouring concentrate adapted to be attached to an open mouthed beverage vessel, the dispenser comprising a reservoir, a manually operable pump and a storage chamber, the reservoir being arranged to contain concentrate, the pump being coupled to the reservoir to dispense a measured quantity of concentrate to the storage chamber, the dispenser being adapted to be secured across the mouth of the vessel whereby tilting of the vessel ensures escape of the concentrate from the storage chamber prior to escape of the beverage within the vessel.

In a further aspect of the present invention there is provided a beverage vessel comprising a receptacle arranged to contain a liquid beverage, the receptacle including a pouring spout, and a removable lid assembly adapted to be secured to the top of the receptacle, a reservoir adapted to contain a flavouring concentrate, the reservoir being positioned within the said receptacle in sealed association with the lid assembly, the lid assembly including a manually operable pump adapted to transfer a measured quantity of flavouring concentrate from the reservoir to the spout whereby as the vessel is tilted to pour the beverage, the transferred quantity of flavouring concentrate leaves the spout before the beverage in the receptacle

DESCRIPTION OF THE DRAWINGS

An embodiment of the present invention will now be described by way of example only with reference to the accompanying drawings in which.

DESCRIPTION OF THE EMBODIMENT

Figure 1:
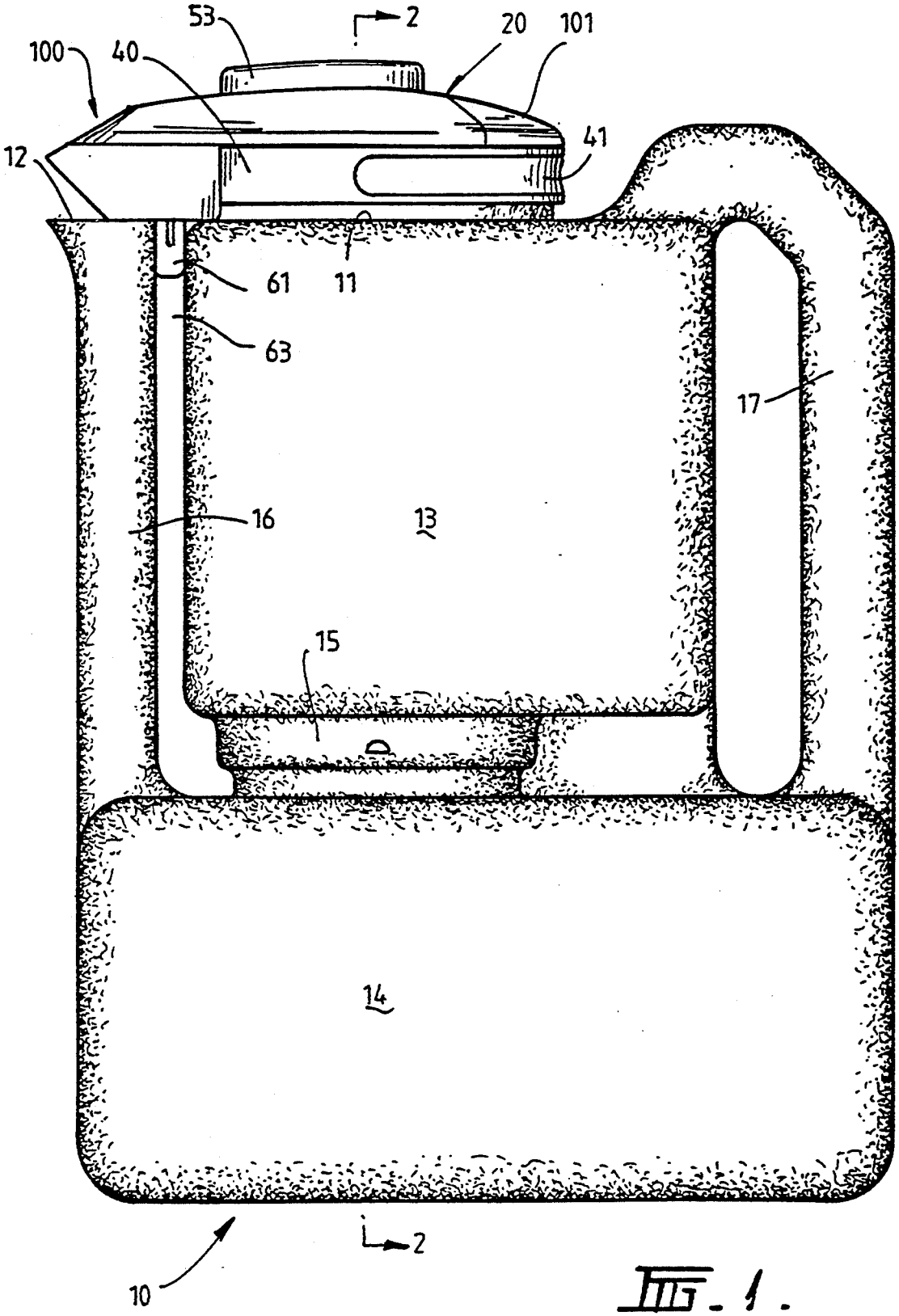
FIG. 1 is a side elevational view of a vessel for beverages including a dispenser in accordance with the invention.
Figure 3:
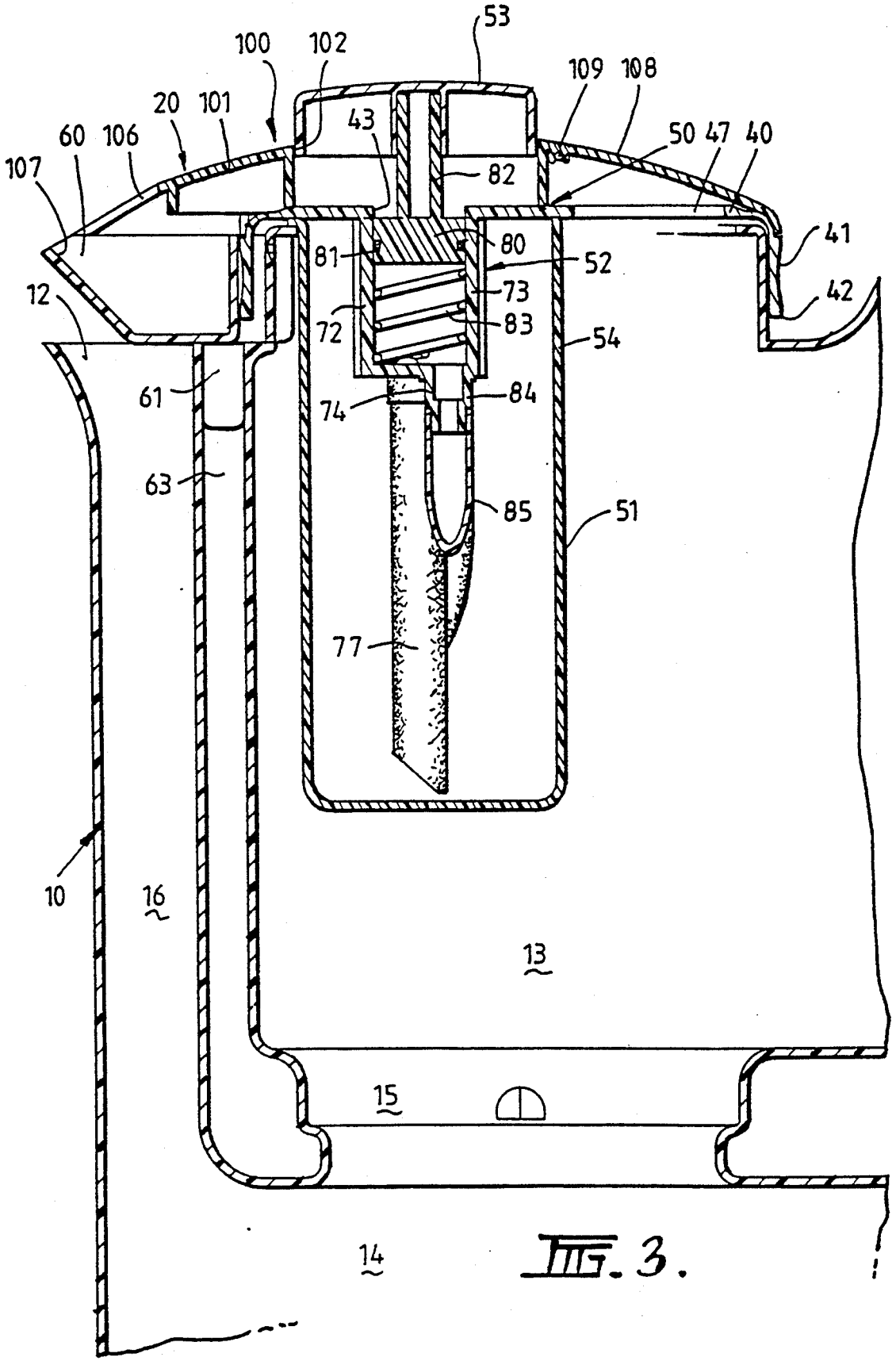
FIG. 3 is a cross sectional view of the vessel taken along the lines 3—3 of FIG. 2.

The beverage vessel 10 illustrated in the accompanying drawings is essentially a modification of a water filter vessel that is the subject of Australian Design Application No. 2044/91. The vessel is moulded in plastics to define a free standing unit with an open mouth 11 at the top. The vessel comprises upper and lower compartments 13 and 14 separated by a narrow fluid passageway 15, a water filter cartridge (not shown) is positioned across the fluid passageway 15. Water entering the vessel 10 from the mouth 11 filters through the water filter cartridge and into the lower vessel 14. The lower vessel 14 includes an outflow passageway 16 which is in direct communication with a spout 12. A carrying handle 17 is formed integrally with the rear of the vessel as shown in FIGS. 1 and 3. A removable lid 20 is normally attached to the top of the vessel to cover and protect the contents of the vessel.

Figure 4:
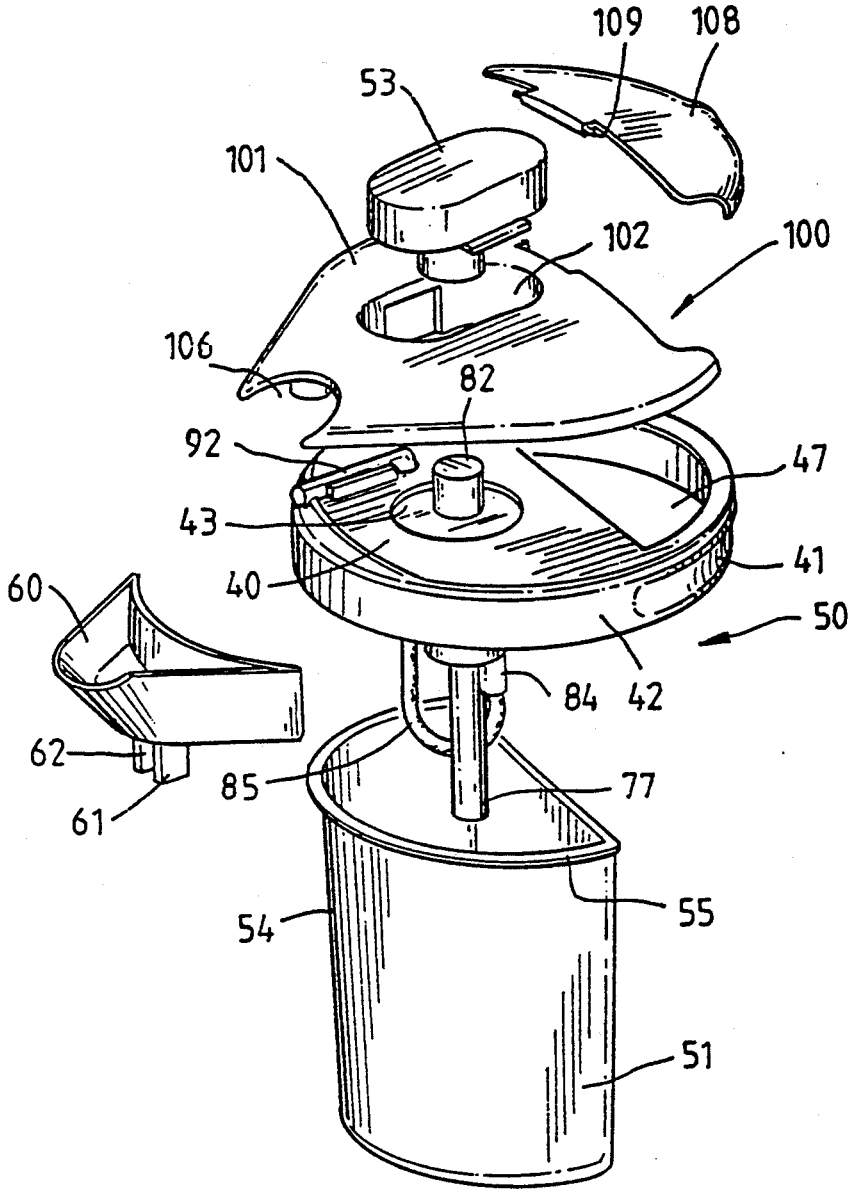
FIG. 4 is an exploded perspective view of the dispenser forming part of the vessel.
Figure 5A:
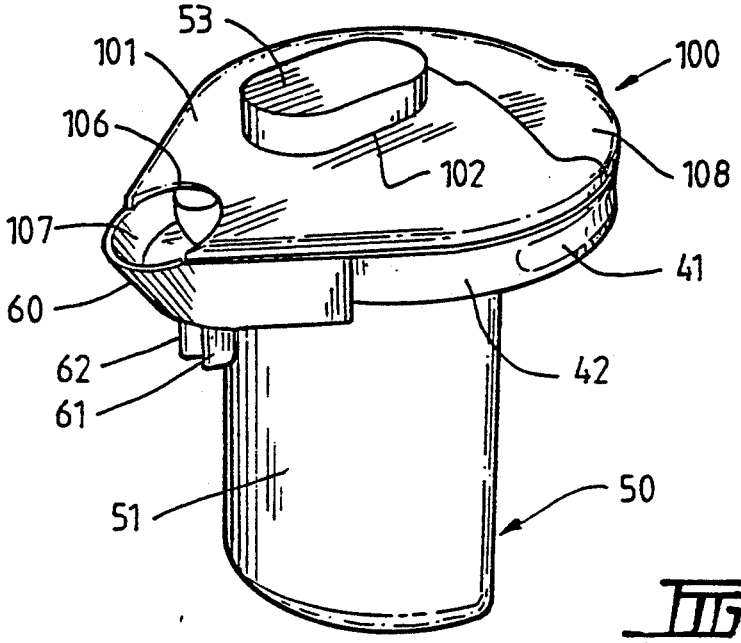
FIGS. 5A and 5B are perspective views of the dispenser of FIG. 4 viewed from the top and underside respectively.
Figure 5B:
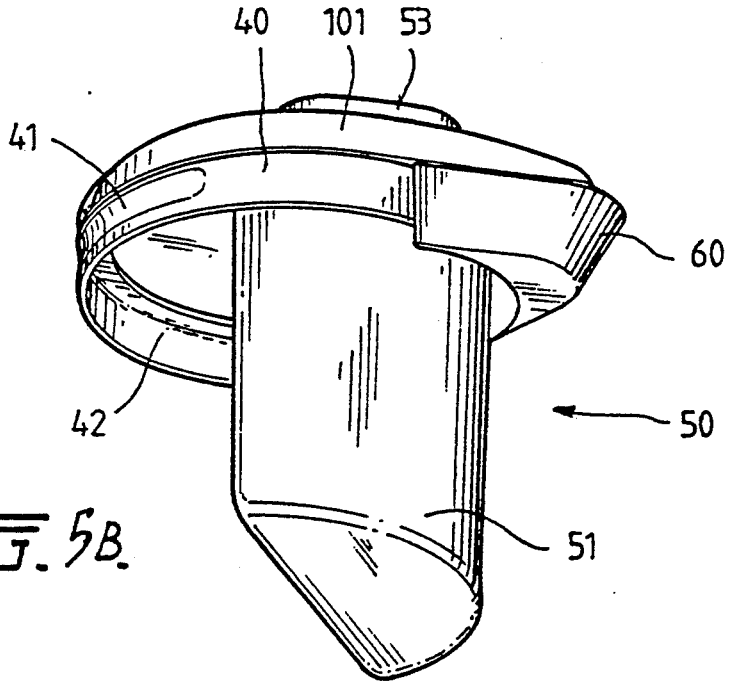

In essence, the invention relates to a dispenser 50 shown in FIGS. 4 and 5 that can be attached to the vessel 10 to provide a source of flavouring concentrate. The dispenser 50 in essence comprises a reservoir 51 and a manually operable pump 52 positioned in a modified lid assembly so that depression of a plunger 53 located on top of the lid assembly can release a predetermined quantity of the flavouring concentrate into a storage chamber 60 near the spout 12 of the vessel so that as the vessel is tipped to release its contents via the outflow passageway 16, the predetermined quantity of concentrate is first released to be followed by the water in the lower compartment 14 of the vessel. The lid assembly includes the componentry that makes up the mechanism for storing and releasing the concentrate and the assembly has been specifically adapted so that it can be screwed onto an existing vessel.

Figure 2:
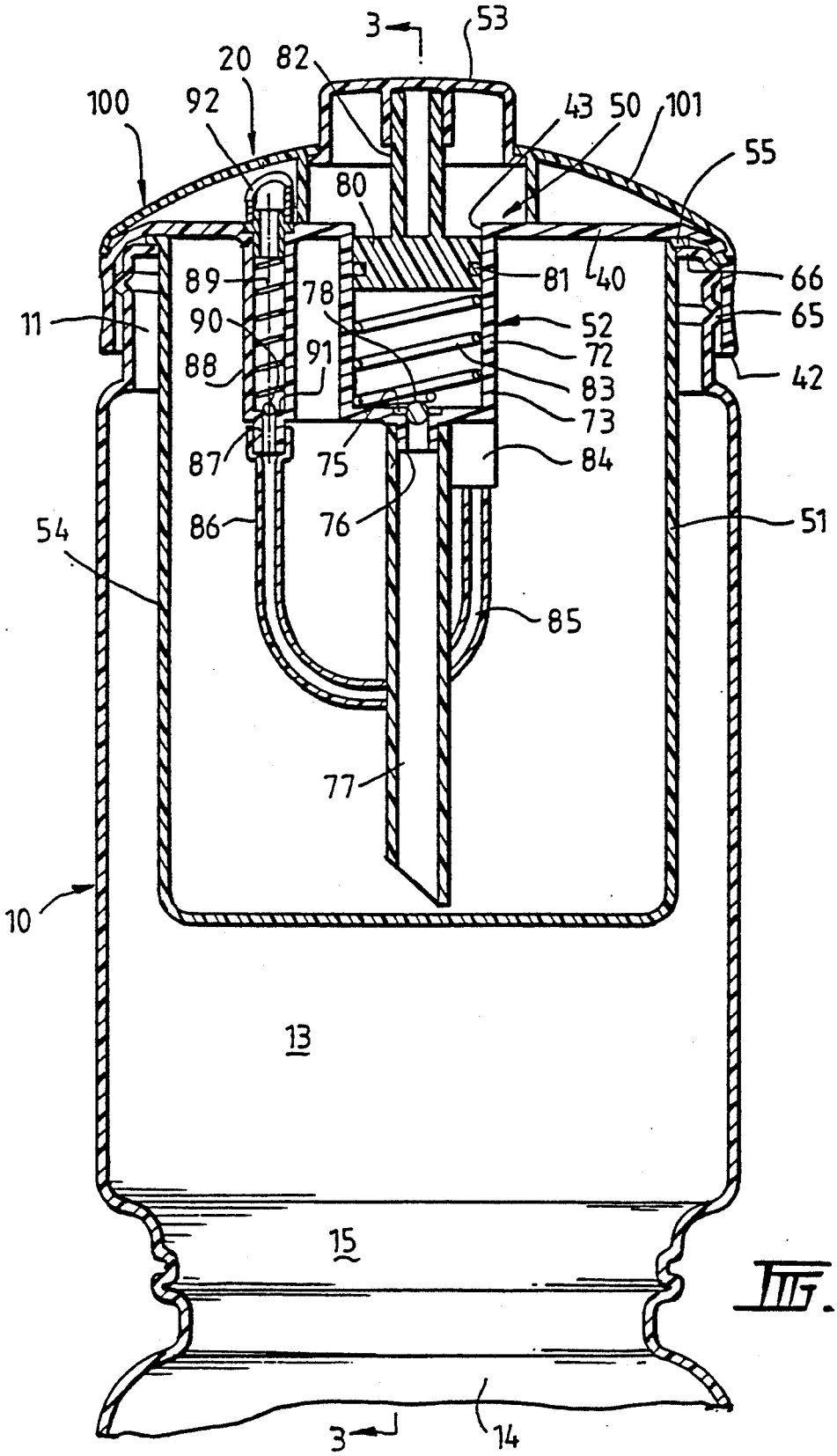
FIG. 2 is a cross sectional view of the vessel taken along the lines 2—2 of FIG. 1.

This componentry is illustrated perspectively in FIGS. 4 and 5 and in cross section in FIGS. 2 and 3. As shown in FIGS. 2 and 3, the mouth 11 of the vessel has an external screw thread 65 and an inwardly facing upper rim 66. The reservoir 51 comprises an open topped receptacle 54 of half moon shaped cross section. The open top has an outwardly projecting rim 55. The receptacle 54 can be placed in the mouth 11 of the vessel so that the rim 55 rests on the upper rim 66 of the mouth 11 of the vessel. An attachment plate 40 of circular cross-section is arranged to fit over the top of the receptacle and is provided with an internal 90° screw thread 41 formed on a downwardly extending rim flange 42. The screw thread 41 cooperates with the external screw thread 65 provided on the mouth 11 of the vessel 10.

The attachment plate 40 is also provided with a semicircular aperture 47 that corresponds to the aperture 48 (FIG. 3) defined by the half of the mouth of the vessel that does not support the reservoir 51 in the reservoir. The pair of apertures 47 and 48 allow access to the interior of the vessel so that the vessel may be filled with water without having to remove the reservoir 51. As shown in FIG. 2, the pump 52 has its body portion formed integrally as downwardly extending cylindrical projection 72 terminating at the top of the attachment plate 40 in a circular aperture 43. The projection 72 defines the pump cylinder 73 which steps down to an inlet 74 defining an inwardly stepped valve seat 75 and an inlet boss 76. The boss 76 supports a feed pipe 77 that opens adjacent the base of the reservoir 51. A small one way valve ball 78 rests on the valve seat 75. A piston 80 is a sliding fit within the cylinder 73 using an 'O' ring seal 81. The piston 80 has an upwardly projecting piston rod 82 that extends through the aperture 43 in the attachment plate 40. The piston 80 acts against a coil spring 83 of sterilised steel or plastics that locates in the cylinder 73. The base of the cylinder 73 is also formed with a stepped exit pipe 84 that is coupled to a flexible feedpipe 85, the other end 86 of which is attached to the lower end 87 of a discharge sleeve 88 also integrally formed as a downward projection from the underside of the attachment plate 40. The discharge sleeve 88 contains a coil spring 89 which acts against a ball valve 90 that seats on an interval valve seat 91. As shown in FIG. 4, the upper end of the discharge sleeve 88 is coupled to conduit 92 which flows into the small storage chamber 60 that is positioned forwardly of the reservoir adjacent the spout 12 of the vessel. The storage chamber 60 is of arcuate configuration with a pair of downwardly extending legs 61 and 62 which locate in a recess 63 formed in the moulding of the vessel adjacent the spout 12.

As shown in FIGS. 2, 3 and 5A, the attachment plate 40 is covered by a cover plate assembly 100 that comprises a slightly upwardly convex main portion 101 with a centrally positioned elongate duct 102 into which the plunger 53 of similar cross section is a sliding fit. The plunger 53 is attached to the free end of the piston rod 82. The main portion 101 attaches onto the top of the attachment plate 40 as shown in FIGS. 2 and 5A. The forward end of the main portion 101 has an arcuate cut-out 106 which defines with the open mouth of the storage chamber 60 a circular outlet 107. The rear of the main portion 101 supports a flap 108 about a hinge 109. The hinged flap 108 covers the aperture 47 in the attachment plate 40 to seal off the filling aperture of the vessel as shown in FIG. 1. Thus, to fill the vessel, it is a simple matter to turn up the flap 108 and pour water into the rear of the vessel through the aperture 47 in the attachment plate.

To adapt an existing filter unit to incorporate a flavouring concentrate dispenser, the existing top is removed and the reservoir 51 is located within the mouth 11 of the vessel 10 and filled with flavouring concentrate such as liquid cordial. The lid assembly 100 shown in FIG. 4 is then attached to the mouth of the vessel 10 which would contain a source of filtered water in the lower compartment 14. To release cordial, the plunger 53 is depressed which in turn causes downward movement of piston 80. Downward depression of the piston 80 compresses the coil spring 83 which has the effect of closing off the ball 78 against the valve seat 75 and forcing air within the cylinder to be expelled to atmosphere via the exit pipe 84. The coil spring 83 then causes the piston 80 to move upwardly thereby drawing in a source of cordial from the bottom of the reservoir 51 and up through the feed pipe 77 via the one way valve 78, 75 into the cylinder 73. The next downward depression of the plunger 53 causes the piston 72 to expel the cordial within the cylinder 73 to the storage chamber 60 via the exit pipe 84, feed pipe 85, discharge sleeve 88 (with the one way valve ball 90 open against the spring 89) and conduit 92. Thus, the user of the vessel can select the number of depressions of the plunger 53 to determine how much cordial is to be pumped in the storage chamber 60 that is adjacent the spout 12. Once the selected quantity of concentrate is in the storage chamber 60, the user can simply tilt the vessel causing water in the base of the vessel to pour out of the spout 12. Inclination of the discharge chamber 60 causes the contents of the chamber to pour out before water leaves the spout 12. Thus, in any pouring action it is always ensured that all the selected concentrate has left the vessel.

The concentrate reservoir 51 is designed to hold between 240 mls of concentrate and the water capacity of the vessel is approximately 1.0 liters. For a conventional cordial that is sold in the supermarket, an 8:1 ratio of cordial to water is recommended. It is however understood that the vessel can be used with highly concentrated concentrate in which the ratio of water to concentrate would increase.

It is understood that the invention is not restricted to liquid concentrate. It is understood that by suitable adaption of the pump, a powdered concentrate could be also dispensed.

In a further embodiment not illustrated in the drawings, it is envisaged that the concentrate reservoir could be divided into three separate compartments each of which would contain a small dispensing pump. The top of the cover plate would then have three plungers and depression of each plunger would select a different cordial. Thus, the vessel could dispense three different flavours which could be selected individually or mixed depending on the taste of the user.

The componentry of the dispenser is simple to disassemble and therefore easy to clean and is made in hygienic washable and durable plastics. The vessel is designed to be free standing in a conventional domestic refrigerator and can be used with tap water with or without a filter cartridge.

The advantage of the vessel having the dispenser is that it provides a unit that can not only provide a source of filtered tap water but provides, if desired, a single or multiple choice of flavourings. Since the flavouring only leaves the jug when the pump is operated, the jug can be used either to dispense pure water or flavoured water with the strength of flavouring depending on the degree of operation of the pump.

Having now described my invention, what I claim is:

1. A beverage vessel comprising a receptacle arranged to contain a liquid beverage, the receptacle including a pouring spout, and a removable lid assembly adapted to be secured to the top of the receptacle, a reservoir adapted to contain a flavouring concentrate, the reservoir being positioned within the said receptacle in sealed association with the lid assembly, and the lid assembly including a manually operable pump for transferring a measured quantity of flavouring concentrate from the reservoir to a storage chamber in fluid communication with the spout such that as the vessel is tilted to pour the beverage, the transferred quantity of flavouring concentrate starts leaving the spout before the beverage in the receptacle.

2. The beverage vessel according to claim 10, wherein the lid of the vessel includes screw threads for attachment across an open mouth of the vessel.

3. The beverage vessel according to claim 2 wherein the reservoir is mounted to one side of the open mouth of the vessel and the lid has a removable cover covering the other side of the open mouth of the vessel such that said other side of the mouth constitutes a filling access for the vessel.

4. The beverage vessel according to claim 1 wherein the lid assembly includes the storage chamber in fluid communication with the pump, the storage chamber being positioned adjacent the pouring spout of the vessel.

5. The beverage vessel according to claim 4 wherein the manually operable pump has a plunger positioned on the lid of the vessel, downward depression of the plunger causing a measured quantity of concentrate stored in the pump to be dispensed to the storage chamber.

6. The beverage vessel according to claim 5 wherein the plunger is biased upwardly to cause the pump to draw another measured quantity of concentrate into the pump.

* * * * *